US007035114B2

(12) United States Patent
Lee

(10) Patent No.: US 7,035,114 B2
(45) Date of Patent: Apr. 25, 2006

(54) USB INTERFACE SOLID MEMORY MODULE WITH STRENGTHENED CLAMPING FORCE

(75) Inventor: Chung-Liang Lee, Taipei (TW)

(73) Assignee: Power Quotient International Co., LTD, Taipei Hsien (TW)

( * ) Notice: Subject to any disclaimer, the term of this patent is extended or adjusted under 35 U.S.C. 154(b) by 100 days.

(21) Appl. No.: 10/437,181

(22) Filed: May 14, 2003

(65) Prior Publication Data

US 2004/0072463 A1 Apr. 15, 2004

(30) Foreign Application Priority Data

Oct. 15, 2002 (TW) ..... 91216350 U

(51) Int. Cl.
*H01R 12/16* (2006.01)

(52) U.S. Cl. ..... 361/785; 361/686; 361/715; 710/62; 439/876; 439/80

(58) Field of Classification Search ..... 361/737, 361/785, 789, 760, 686, 741, 715; 439/79–80, 439/876, 860; 455/90.3; 710/62, 305; 711/715; 257/678

See application file for complete search history.

(56) References Cited

U.S. PATENT DOCUMENTS

| | | | | |
|---|---|---|---|---|
| 6,434,648 | B1 * | 8/2002 | Assour et al. | 710/305 |
| 6,490,163 | B1 * | 12/2002 | Pua et al. | 361/737 |
| 6,612,498 | B1 * | 9/2003 | Lipponen et al. | 235/486 |
| 6,639,309 | B1 * | 10/2003 | Wallace | 257/678 |
| 6,744,634 | B1 * | 6/2004 | Yen | 361/752 |

* cited by examiner

*Primary Examiner*—Kamand Cuneo
*Assistant Examiner*—Hung S. Bui
(74) *Attorney, Agent, or Firm*—Troxell Law Office, PLLC

(57) ABSTRACT

The present invention discloses a USB interface solid memory module, comprising: a USB data transmission interface, being an interface in the module for transmitting data to a system; a USB interface controller, being a controller for converting an interface data and accessing a digital data in a memory; a memory array, at least having a non-volatile memory for serving as a data storage device electrically coupled to a circuit corresponding to said USB interface controller; and a USB interface connector, for connecting a USB signal with the system, such that said connector being directly coupled with a USB interface slot disposed in the system, without requiring a USB signal cable.

2 Claims, 3 Drawing Sheets

USB INTERFACE SOLID MEMORY MODULE WITH STRENGTHENED CLAMPING FORCE

BACKGROUND OF THE INVENTION

1. Field of the Invention

The present invention relates to a universal serial bus (USB) interface solid memory module, more particularly to a USB interface solid memory module with strengthened clamping force.

2. Description of the Related Art

The solid disk on module using an IDE interface as the data transmission interface has been generally used in various industrial computer systems. For small industrial control computer system, if the size of the solid disk on module can be reduced further, it can be more easily designed into the small computer systems. However, the standard IDE interface slot limits the size because the solid disk on module has too many signal pins (say, 40 pins). The width of the foregoing solid disk on module that uses the IDE interface as the data transmission interface cannot be further reduced. In the meantime, the stability of the module after being installed is also limited by the existing IDE slot structure and cannot be enhanced effectively. It is undoubtedly an issue to the industrial system that requires improvements.

As to the computer peripherals, the way of reducing the size of the solid disk on module, being compatible with the existing industrial computer interfaces, standardizing its specification, and redesigning a highly integrated module to provide a more stable module while matching with the user's operating habits become the concerned topics.

In view of the above description, the inventor of the present invention based on years of experience accumulated from the engagement in the computer related industry and conducted extensive research and found another way to overcome the aforementioned shortcomings and invented the "USB interface solid disk on module" according to the present invention.

The study on the shortcomings of the foregoing IDE interface solid disk on module shows that the product design is limited by the features of the existing IDE interface slot and cannot have the full functions. Therefore, the inventor of present invention herein completely improves the foregoing shortcomings by removing the IDE interface from the solid disk on module and adopting another popular USB interface generally used in the computer system. The USB interface is used to simplify the size of the interface of the memory module, because the USB interface has less signal pins (say 4 pins) in addition to the grounding signal. Therefore, such feature used for the design of the solid disk on module can give a smaller size for the products. The shortcoming of the USB interface in the past resides on its slow data transmission speed, which is not suitable for the application on the data storage device of this type. However, the new USB 2.0 industrial specification has upgraded the data transmission speed up to 480 Mbits/sec, and thus resolving the data transmission speed problem.

Since the USB interface slot is an external signal connection design, which is not suitable for the design of embedded devices, therefore the inventor of this invention redesigned an embedded USB interface device structure. By such redesigned structure, the shortcomings of the aforementioned IDE interface slot that lacks stability can be overcome. Thus, an embedded USB interface slot device with strengthened terminal clamping force is another important product design disclosed by the inventor of this invention.

SUMMARY OF THE INVENTION

The primary objective of the present invention is to provide a USB interface solid disk on module with strengthened clamping force.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
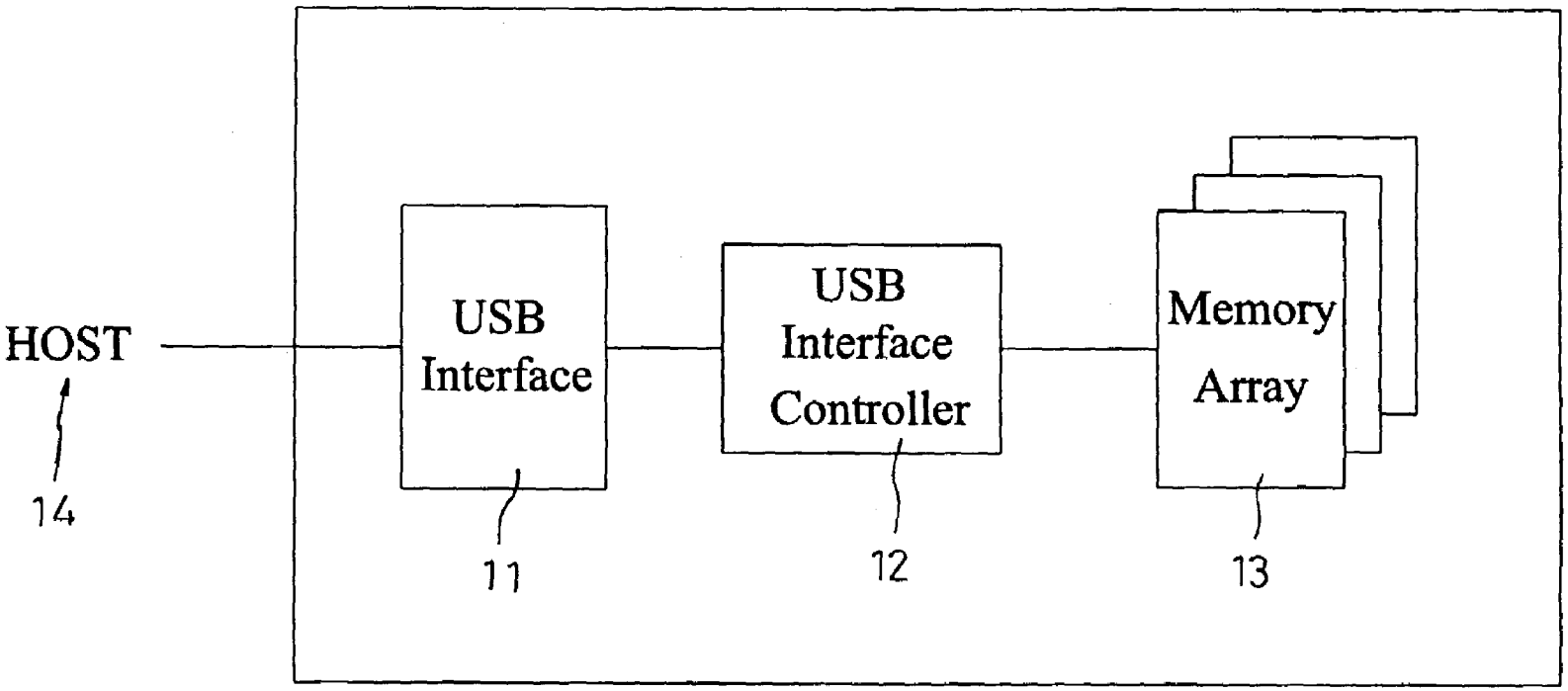
FIG. 1 is a block diagram of the circuit of the USB interface solid disk on module according to the present invention.

Please refer to FIG. 1 for the block diagram of the circuit of the present invention, wherein a signal is sent through a USB interface 11 to a USB interface controller 12, and after such USB interface controller 12 converts the USB signal, the digital data is then sent to and stored into the memory array 13. On the other hand, after the interface controller 12 has received the request for reading the data from the host 14, the data stored in the memory array 13 is read, and the digital data is converted into the USB signal format and then sent to the host 14 via the USB interface 11 to complete reading the data.

Figure 2B:
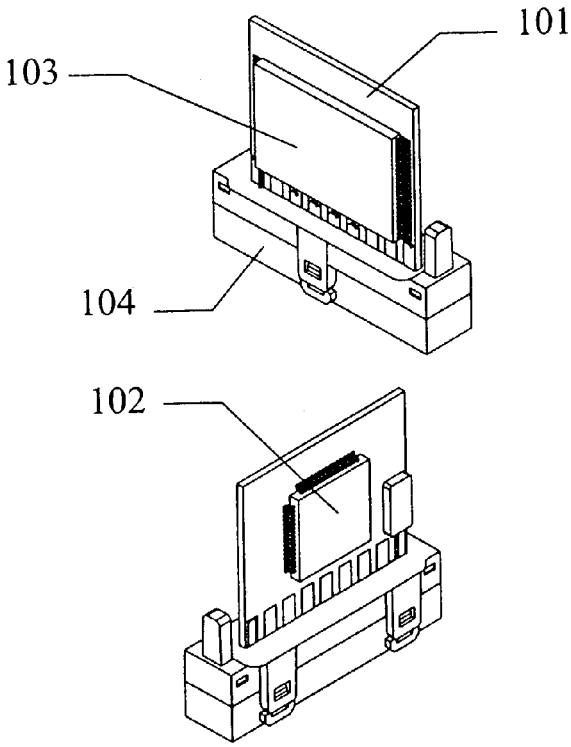
FIGS. 2*a* and 2*b* are illustrative diagrams of the external appearance and the interior of the USB interface solid disk on module according to the present invention.
Figure 2A:
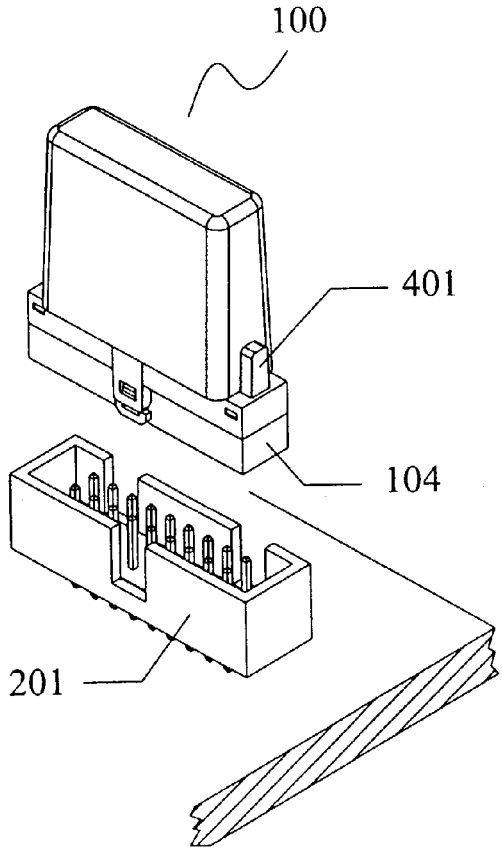

Refer to FIGS. 2*a* and 2*b* for the illustrative diagrams of the appearance and interior of the USB interface solid disk on module disclosed in this invention, wherein the USB interface solid disk on module 100 comprises a printed circuit board 101, an interface controller 102, a memory 103 for storing data, a USB connector 104, and a USB interface slot 201. The interface controller 102 and the memory 103 are disposed on both sides of the printed circuit board 101 to attain the purpose of reducing the size of the modules, and a USB interface slot 201 is mounted onto the printed circuit board 101 of the main computer system. By means of an appropriate circuit layout, the USB signal can be connected. To increase the integration of the connector and maintain a good signal contact in a severely shaking environment without losing the convenience of the module assembling and operation, the inventor of this invention applied "a design of a terminal with strengthened terminal clamping force used for connectors" disclosed in the R.O.C. utility model Patent No. 183451 invented by the inventor of this invention into the USB connector 104 and the USB interface slot 201. The structure of such terminal structure and the new mechanical design are merged in this invention to attain the desired objectives.

Figures 3A, 3B:
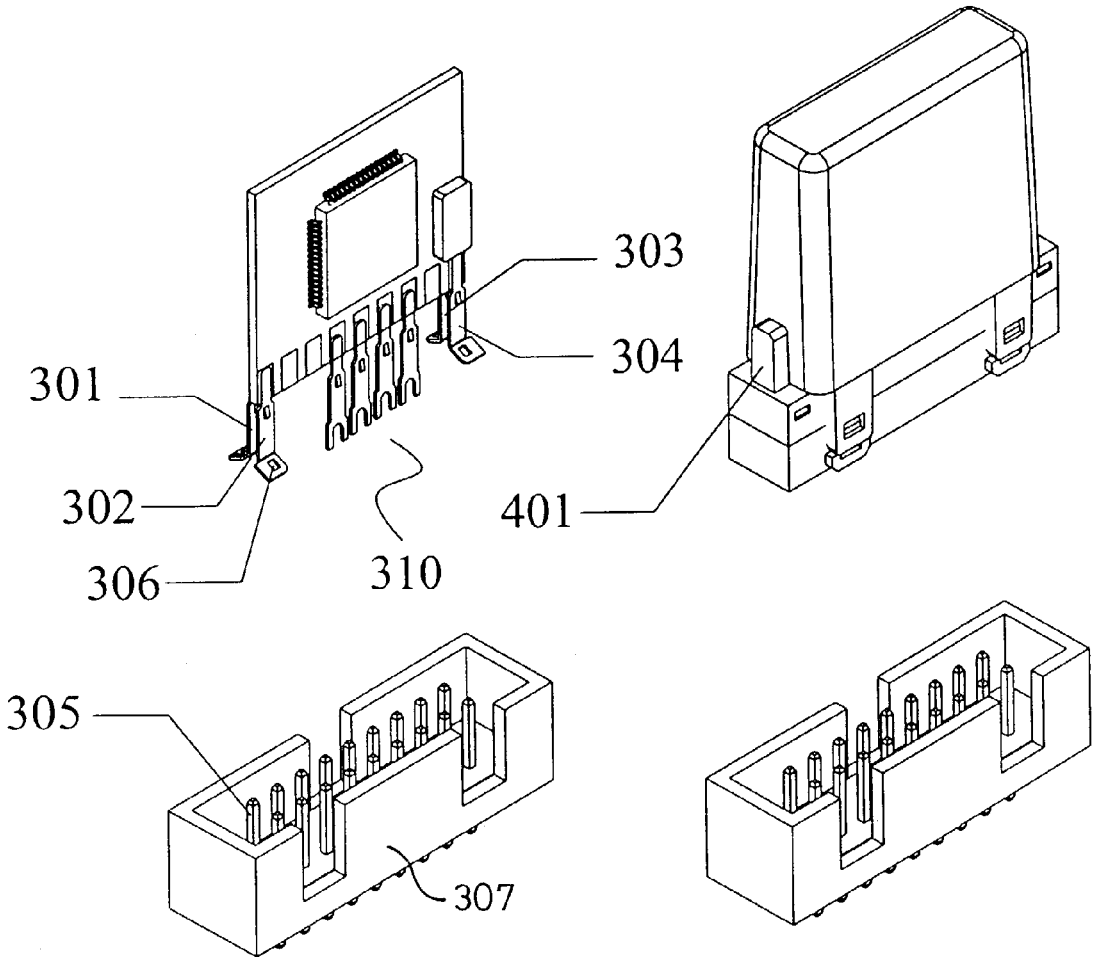
FIGS. 3*a* and 3*b* are perspective diagrams of the structure of the USB interface connector according to the present invention.

Please refer to FIGS. 3*a* and 3*b* for the diagrams of the USB interface connector for further illustration. The USB interface connector of the present invention comprises a J-type terminal disposed on the surrounding of the connector and indicated by the numbers 301, 302, 303, 304 and the stress adjuster 401 and the USB interface signal terminal module of this invention 310. Besides two sets of standard USB signals, the USB interface connector also includes an additional power supply terminal for supplying the required electric power by connecting to the external independent power supply when the power supply provided by the USB interface is insufficient. After a module 100 is inserted into the USB interface slot 307, the pin 305 will pass through an opening 306 at the end of the J-type terminal, and the movement of the stress adjuster 401 is used to cause the J-type terminal 301, 302, 303, and 304 to deform and engage with the pin 305, and thus decreasing the horizontal cross-sectional area of the opening 306. At that time, the J-type terminal 301, 302, 303, and 304 will securely engage with the pin 305 to attain the purpose of securing the connector. Once the stress adjuster 401 restores its original status, the J-type terminal 301, 302, 303, and 304 will restore its original status and no longer engages with the pin 305 to detach the connector. Such design does not require additional screws and tools and keeps the convenience of assembling the connector.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. A USB interface solid memory module for use with a computer system comprising:

a) a USB data transmission interface receiving a signal from and transmitting a USB signal format to the computer system;

b) a USB interface controller receiving and converting the signal from the USB data transmission interface into digital data;

c) a memory array receiving and storing the digital data therein and having a non-volatile memory serving as a data storage device, the USB interface controller selectively reading the digital data from memory and transmitting the USB signal to the USB data transmission interface; and d) a connector removably connected to a USB slot of the computer system and having a stress adjuster movable between first and second positions and selectively connecting the connector to the USB slot, wherein the connector having a plurality of deformable terminals, each of the plurality of deformable terminals having an opening selectively receiving one of a plurality of pins of the USB slot, the stress adjuster selectively deforming the plurality of deformable terminals:

a) when the stress adjuster is in the first position, the plurality of deformable terminals are deformed and one of the plurality of pins of the USB slot is slidably inserted into each opening of the plurality of deformable terminals, and b) when the stress adjuster is in the second position and the connector is connected to the USB slot, each of the plurality of deformable terminals is located in a normal position engaging one of the plurality of pins of the USB slot.

2. A USB interface solid memory module, comprising:

a USB data transmission interface in the module for transmitting data to a system;

a USB interface controller for converting an interface data and accessing a digital data in a memory;

a memory array, at least having a non-volatile memory serving as a data storage device electrically coupled to a circuit corresponding to said USB interface controller; and a connector connecting a USB signal with the system, such that said connector is directly coupled with a USB interface slot disposed in the system, without requiring a USB signal cable, wherein said connector further comprises a deformable terminal therein, and said terminal has an opening for passing a pin through, and engaging said pin by means of the deformation of said terminal to produce a clamping force between said terminal and said pin.

* * * * *